US006015334A

United States Patent [19]

Hundebøl

[11] Patent Number: 6,015,334

[45] Date of Patent: Jan. 18, 2000

[54] METHOD FOR THE DEBURRING OF ITEMS, PARTICULARLY ITEMS OF METAL, AND USE OF THE METHOD

[75] Inventor: Keld Otting Hundebøl, Ansager, Denmark

[73] Assignee: HH Patent A/S, Ansager, Denmark

[21] Appl. No.: 09/043,540

[22] PCT Filed: Aug. 5, 1997

[86] PCT No.: PCT/DK97/00326

§ 371 Date: Mar. 23, 1998

§ 102(e) Date: Mar. 23, 1998

[87] PCT Pub. No.: WO98/05472

PCT Pub. Date: Feb. 12, 1998

[30] Foreign Application Priority Data

Aug. 5, 1996 [DK] Denmark ..... 0830/96

[51] Int. Cl.[7] ..... B24B 7/00

[52] U.S. Cl. ..... 451/28; 451/362

[58] Field of Search ..... 451/130, 28, 131, 451/150, 182, 362

[56] References Cited

U.S. PATENT DOCUMENTS

| | | | |
|---|---|---|---|
| 415,886 | 11/1889 | Stuckel | 451/362 X |
| 1,544,083 | 6/1925 | Whitten | 451/182 X |
| 3,597,881 | 8/1971 | Olton | 451/131 X |
| 4,646,473 | 3/1987 | Hundebol . | |
| 4,646,479 | 3/1987 | Walker et al. . | |
| 4,704,823 | 11/1987 | Steinback . | |
| 4,835,913 | 6/1989 | Blanton . | |
| 5,105,583 | 4/1992 | Hammond et al. . | |
| 5,125,192 | 6/1992 | Welsch . | |
| 5,291,689 | 3/1994 | Hundebol . | |
| 5,441,440 | 8/1995 | Hundebol . | |
| 5,468,173 | 11/1995 | Winton, III . | |
| 5,531,636 | 7/1996 | Bissen | 451/150 X |
| 5,601,481 | 2/1997 | Hundebol . | |
| 5,649,851 | 7/1997 | Boucherie | 451/150 X |

FOREIGN PATENT DOCUMENTS

| | | | |
|---|---|---|---|
| 164275 | 6/1992 | Denmark . | |
| 165549 | 12/1992 | Denmark . | |
| 0 320 558 A1 | 12/1987 | European Pat. Off. . | |
| 0 471 641 | 2/1992 | European Pat. Off. . | |
| 63-156653 | 6/1988 | Japan | 451/131 |
| WO 91/17867 | 11/1991 | WIPO . | |

OTHER PUBLICATIONS

Revised Search Report WO 98/05472 filed Feb.12, 1998.

*Primary Examiner*—David A. Scherbel
*Assistant Examiner*—Anthony Ojini
*Attorney, Agent, or Firm*—Nims, Howes, Collison, Hansen & Lackert

[57] ABSTRACT

The invention is a method for deburring items, especially metal items which have sharp edges or burrs resulting from punching, clipping, molding or other machine operations. The items are fed under a deburring tool which sweeps the surface of the items, the deburring tool having a number of deburring rollers, each secured to an individual rotatable spindle axle which extends radially outward from a drive. The deburring rollers rotate around the spindle axles while all the spindle axles are also being turned around a turning axle which extends at a right angle to the spindle axles. The deburring rollers are also moved in a reciprocating manner in a direction transverse to the feeding direction. The method is of particular use in the deburring of ribs for aircraft wines and other similar items.

5 Claims, 4 Drawing Sheets

Figure 1:
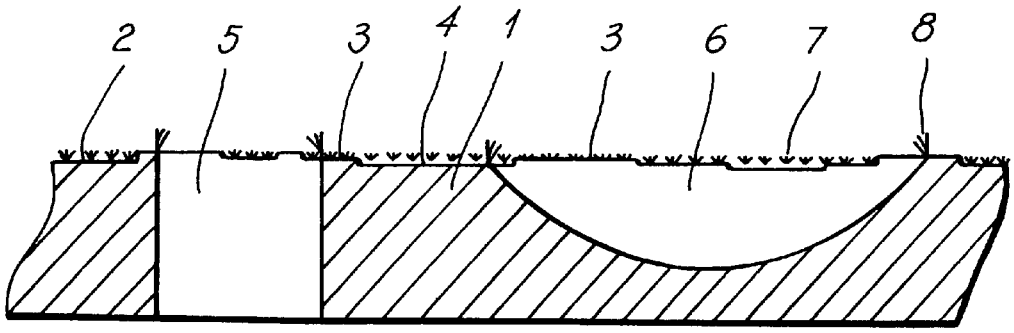

METHOD FOR THE DEBURRING OF ITEMS, PARTICULARLY ITEMS OF METAL, AND USE OF THE METHOD

AREA OF APPLICATION OF THE INVENTION

This invention concerns a method for the deburring of items, particularly metal items which are encumbered with sharp edges or burrs after punching, clipping, moulding and/or machining operations.

The invention also concerns the use of the method for the deburring of ribs for aircraft wings, plate items and the like.

TECHNICAL BACKGROUND OF THE INVENTION

Deburring is a problem not only in the production of innumerable items of metal, but also in the production of items of other materials, for example items of plastic, where the items can have flashed edges or projections.

When the deburring of items of metal is involved, it is often a great advantage if a uniform chamfer can be produced on the contour of the item.

In addition to the manual deburring of the individual items by a worker using a file, there are also various technologies for deburring during mass production, such as electrolytic deburring and vibration in an abrasive material, grinding, sandblasting, rinsing with various materials and high-pressure flushing with abrasive additives.

The above-mentioned methods of deburring during mass production have a number of disadvantages, of which the following can be mentioned:

1)The items must be separated from the abrasive,

2)The items must be cleaned of dust/liquids,

3)The items can damage one another by mutual contact,

4)The items are heated by the deburring process,

5)The processes are slow,

6)There often occurs a so-called folding-back of the burrs or flash, and

7)The result of the deburring varies and depends on the shape of the items, for example at a circular hole, where different chamfer radii can appear along the edge of the hole.

From U.S. Pat. No. 5,468,173 there is known a machine for the deburring of metal items, said machine comprising two sets of deburring heads each with four deburring rollers provided with abrasive leaves which extend radially outwards from a retaining cylinder. All of the deburring rollers are rotated and turned in the same direction across the item which is to be deburred.

However, this machine is not suitable for deburring in corners and narrow passages, the reason being that the breadth of the deburring leaves sets a limit for the breadth of the opening which can be processed.

Furthermore, the relative stiffness of the leaves sets a limit for their possibility of adjusting themselves to different contours and edges.

Despite the many different methods and machines for deburring, many deburring tasks must still be carried out manually, in that this is made necessary by the above-mentioned disadvantages and the demand concerning uniform chamfer radii along the multifarious contours of the items.

Manual deburring is, however, time-consuming and therefore costly in mass production. Moreover, scratches often appear in the deburred edges, which scratches can contribute towards the formation of cracks, which in turn can lead to fractures in the items.

In the aviation industry, there thus exits a problem in the manufacture, for example, of ribs for aircraft wings or similar items. These ribs are made of a large metal item which is machined to the precise configuration. When the ribs are thus brought down to their final dimensions, the burrs which result from the machining must be removed during simultaneous chamfering with quite precise chamfer radii of the edges at holes and outer edges. These chamfers shall not only have a certain radius, but the chamfers must also be completely free of scratches or marks after the deburring, in that such scratches or marks can lead to the formation of cracks as a consequence of vibrations in the finished ribs when they are mounted in an aircraft wing or a similar place.

The Technical Problem Which Needs to be Solved

There is thus a need for being able to carry out the deburring of metal items without this giving rise to scratches or cracks in the deburred edges of the items, in that at the same time as the deburring there shall also be produced chamfers with uniform radii on the contours of the items.

Where the items are to he given subsequent surface treatment, it is desirable that the deburring is effected with uniform contours, in that it is hereby ensured that the surface coating, such as paint, can be applied in a layer of the desired thickness.

The New Technique

It is therefore the object of the present invention to provide a method for the deburring of metal items which are encumbered with sharp edges or burrs after punching, clipping, moulding and/or machining operations.

This object is achieved with a method of the kind disclosed in the preamble, said method according to the invention being characterized by the items being fed in under a deburring tool which sweeps the surface of the items, said deburring tool comprising a number of deburring rollers which are comprised of deburring disks, each of which consists of a circularly-cut piece of abrasive material provided with radial slits in the formation of a large number of abrasive fingers, said deburring disks each being secured to its own spindle axle which extends radially outwards from a drive, said deburring rollers rotating in opposite directions in pairs around the spindle axles, and also being turned around a turning axle which extends at right-angles to the spindle axles, in that the deburring rollers are also moved in a reciprocating manner parallel with the surface of the items in a direction transversely to the feeding direction of the items.

If the items have at least a partly plane underside, it is also advantageous to feed the items on a vacuum surface which can secure the items during their forward feeding under the deburring tool, in that the movement of the air serves to cool the surface of the items.

The Technical Effect

It has surprisingly proved that the effect of the deburring and the processing is concentrated on the edges of the items where the burrs are normally left remaining or are folded over, also that the items are not influenced by process heat, in that the deburring disks create circulation for cooling of the items' surfaces, also that the deburring does not call for subsequent cleaning since the process is effected in a dry manner, and that even on complex items there is achieved a uniform, similar chamfer radius on all contours, regardless of whether these contours extend on outer edges of the items or on edges of holes of different shapes.

Those areas on the items surfaces which lie between the mentioned edges shall, on the other hand, be ground even and smooth without any significant removal of material.

The fingers on the deburring disks provide a great flexibility, which allows the fingers to penetrate some distance down into recesses and holes in the items, so that the chamfering on the contours can achieve the intended radius. Similarly, the relatively narrow fingers can penetrate down into narrow openings and passages and enable these to be processed.

Moreover, the effect of the oppositely-rotating deburring tools is that the item is not influenced in one and the same direction, which means that the holding power on the plane does not need to be particularly great. This results in great assurance for a precise deburring and shape.

The effect of placing the items on a vacuum plane is therefore that they are held in a secure manner during the processing and, in addition, that a cooling effect is provided on the surface of the items during the deburring.

With smooth items, it has hitherto been difficult in a subsequent surface treatment in the form of painting/lacquering to get the treatment material to adhere to the surface of the items.

When the items are deburred/frazed by the method according to the invention, it has proved that the surface treatment material achieves a surprisingly good adherence to the surface of the items.

Therefore, the method according to the invention can with advantage be used for the deburring of ribs on wings for aircraft while simultaneously chamfering various edges on the ribs, and plate items can be processed in a similar manner.

The Drawing

Figure 2:
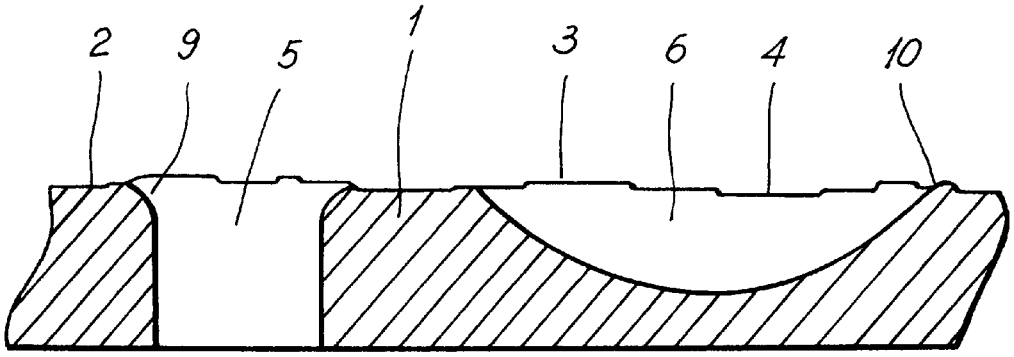
Figure 3:
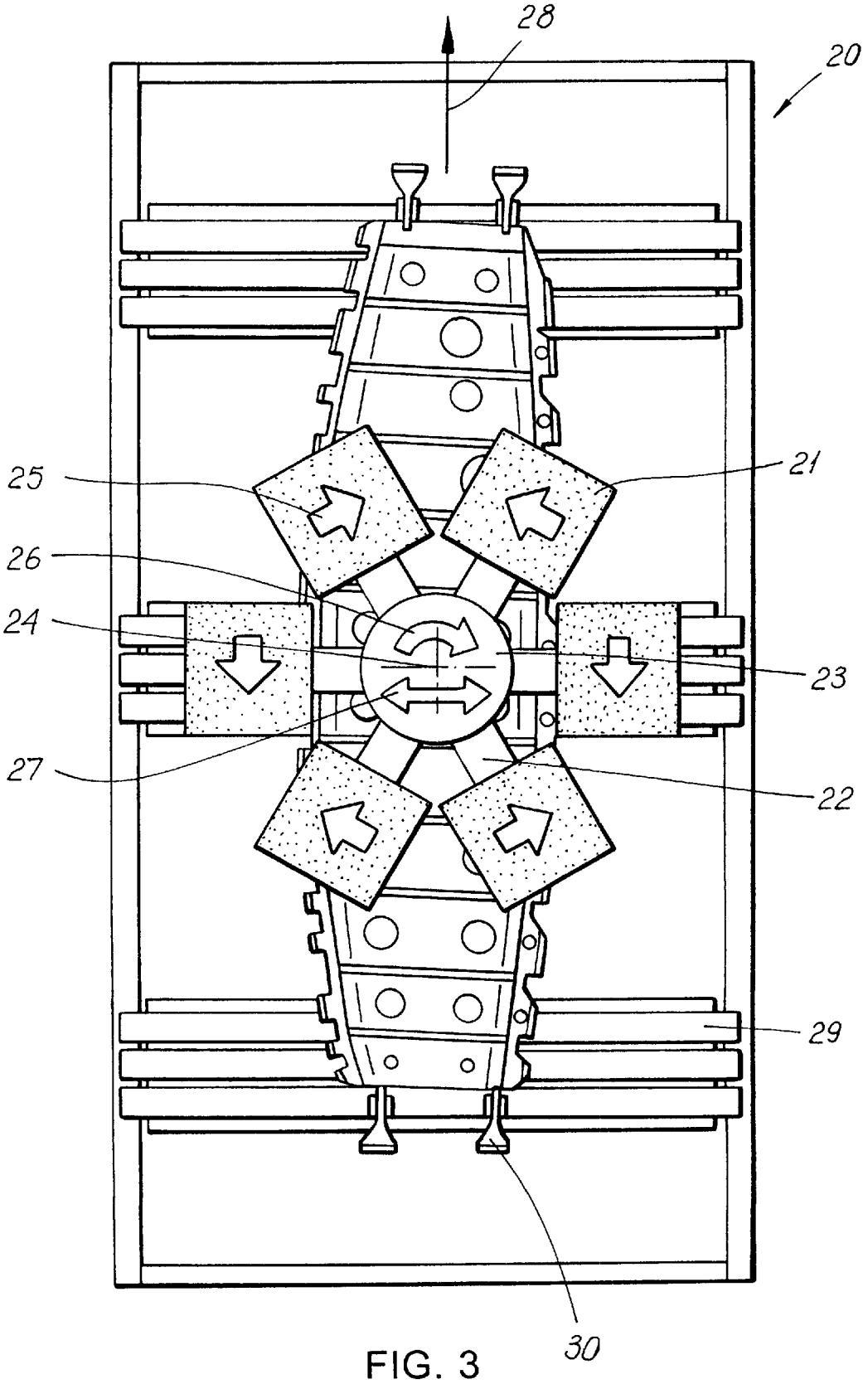
Figure 4:
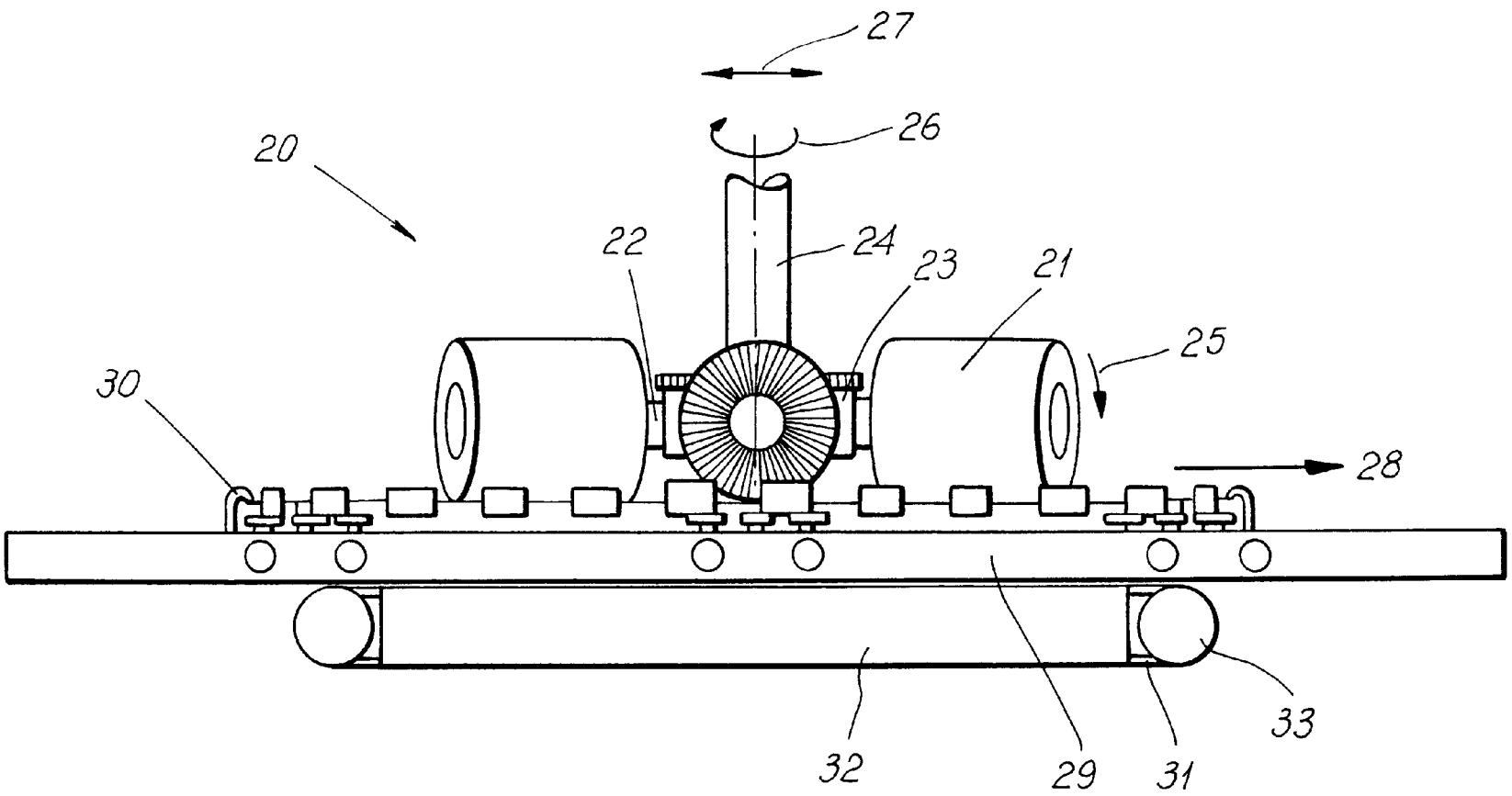
Figure 5:
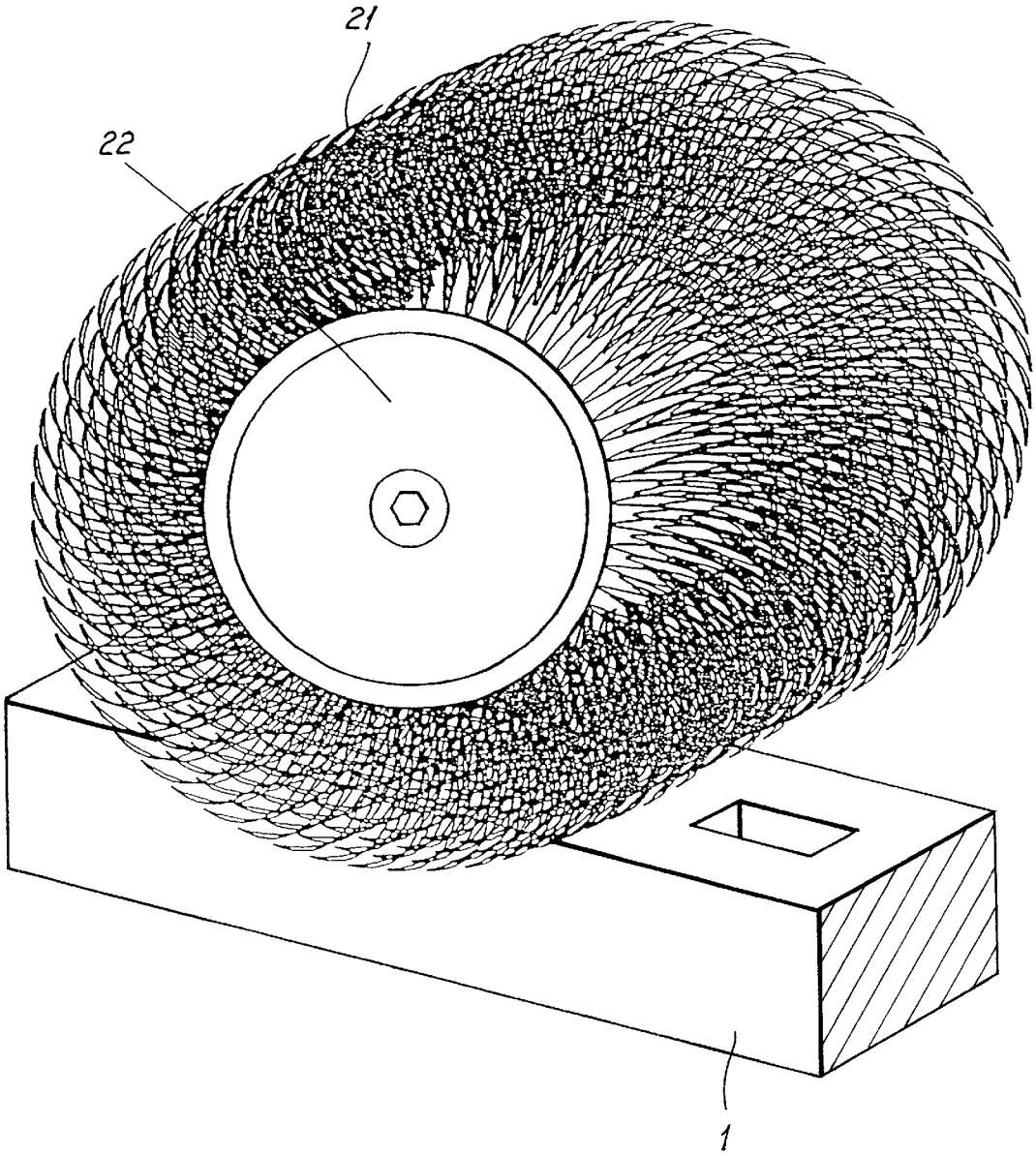

In the following, the method according to the invention and the use thereof for the deburring of, for example, ribs for aircraft, will be described in more detail with reference to the drawing, where FIG. 1 shows a part section in an item with small arrows indicating narrow grooves which arise with machining, and with larger arrows indicating sharp burrs which requires to be removed and/or chamfered by a general deburring of the item's surface, FIG. 2 shows the item depicted in FIG. 1 after deburring using the method according to the invention, FIG. 3 shows a plane view of a rib for an aircraft wing which is deburred in a machine by the method according to the invention, in that the composite movement of the deburring tool is indicated by arrows, FIG. 4 schematically shows a side view of the machine with the rib during the deburring shown in FIG. 3, and FIG. 5 shows on a larger scale a deburring roller which is made up of several deburring disks.

In FIG. 1 is shown a cross-section of an item 1, the surface 2 of which has projections 3 and grooves 4 in accordance with the item's final form. The projections 3 and the grooves 4 have a certain extent. There is also seen a through-going hole 5 and a recess 6. A series of grooves, tracks or recesses is indicated by the reference number 7, which stem from the cutting tool during machining such as milling or turning, and the reference number 8 indicates sharp burrs which must be removed as a link in the final processing of the item.

These grooves, tracks or recesses 7 and the burrs 8 must be removed, in that various edges, i.e. the edges around the hole 5 and the recess 6 must also be chamfered as shown by 9 and 10 respectively, while the surface 2 at the projections 3 and grooves 4 merely require to be smoothed out during the removal of the least possible amount of material, as indicated in FIG. 2.

This is achieved with the method according to the invention, where the item 1 as shown in FIG. 3 and 4 is fed in under a deburring tool which sweeps the surface 2 of the items 1, said deburring tool comprising a number of deburring rollers 21 mounted on individual spindle axles 22 which extend radially outwards from a drive 23, in that said deburring rollers 21 are not only rotated around the spindle axles 22 (the arrow 25) but also turned (the arrow 26) around a turning axle 24 which extends at right-angles to the spindle axles 22, in that the deburring rollers 21 are further moved in a reciprocating manner (the double arrow 27) parallel with the surface 2 of the item 1 in a direction transversely to the feeding direction (the arrow 28) of the item.

It is with advantage that adjacent deburring rollers 21 rotate in opposite directions, as shown by the oppositely-directed arrows 25 in FIG. 3. During the deburring, the item 1 is fed forward on a worktable 29 and is secured in a commonly-known manner by means of clamping tools 30.

If, however, the current item 1 has a flat underside of a certain extent, it is advantageous to use as a worktable a conveyor belt which has a perforated surface 31, under which there is a chamber 32 which is connected to a source of vacuum (not shown in the drawing), so that during the deburring the item 1 is secured by a vacuum. The conveyor belt is endless and runs over rollers 33 which are arranged to support the worktable 29.

As indicated in FIG. 5, the deburring rollers 21 are composed of a number of deburring disks, each of which consists of an abrasive material cut out in a circle, and which are provided with radial cuts to form a large number of deburring fingers which extend radially from the deburring rollers 21 and axles 22. Moreover, the axial extent of the deburring rollers 21 can be adjusted in accordance with the current deburring task by varying the number of deburring disks on the spindle axles 22.

The deburring fingers on the deburring disks 21 provide a great flexibility, which enables thee deburring fingers to penetrate some distance down into the holes 5 and the recesses 6 in the item 1, so that the chamfering of the contours can be achieved with the intended radius. On the other hand, when the deburring fingers pass over a plane area of a certain extent, such as at the projections 3 and the grooves 4, the deburring fingers are pressed together and thus remove only an insignificant part of the surface material.

The method will now be explained using the following example.

EXAMPLE

For the testing of the efficiency of the method disclosed, a trial has been carried out at Deutsche Aerospace Airbus with deburring/frazing on a deburring machine with the designation FLADDER 300/GYRO, where the name FLADDER is a registered trademark. The machine 20 comprises a frame (not shown in the drawing) in which are suspended the disclosed deburring tool with deburring rollers 21, spindle axles 22, drive 23, turning axle 24, worktable 29 and/or vacuum table 31, 32, 33.

For the trial, the machine 20 had a spindle length of 350 mm, 6 spindles and a total of 168 deburring disks distributed on the spindles, which rotated in pairs in opposite directions. The deburring disks were coated with a grade 220 abrasive grit and were 300 mm in diameter, in that a selection could be made only from diameters between 250 to 500 mm. Moreover, the engagement or working depth was set at 8 mm. The item was a 1.6 mm-thick plate of aluminium in which holes had been drilled. The item was secured by means of a vacuum table which could feed the item forward at various speeds.

Results of the Trial

Chamfering of Edges

On the machine it was possible to vary the number of revolutions of the deburring rollers, the feeding speed of the worktable and the depth of penetration of the deburring fingers. In order to determine the influence of these factors on the result, trial items were deburred at various revolutions and feeding speeds. The chamfering of edges was measured at an outer edge and in a hole with a diameter of 2.4 mm.

The results obtained for the chamfer radii at a feeding speed of 1.0 m/min. are as follows:

| Revolutions per min. | 1130 | 1240 | 1360 | 1500 |
|---|---|---|---|---|
| Outer edge (mm) | 0.3 | 0.3 | 0.2 | 0.4 |
| Hole (mm) | 0.1 | 0.1 | 0.1 | 0.1 |

The results obtained for the chamfer radii at a feeding speed of 1.25 m/min. are as follows:

| Revolutions per min. | 1130 | 1240 | 1360 | 1500 |
|---|---|---|---|---|
| Outer edge (mm) | 0.20 | 0.20 | 0.30 | 0.30 |
| Hole (mm) | 0.05 | 0.10 | 0.15 | 0.50 |

The results obtained for the chamfer radii at a feeding speed of 1.50 m/min. are as follows:

| Revolutions per min. | 1130 | 1240 | 1360 | 1500 |
|---|---|---|---|---|
| Outer edge (mm) | 0.15 | 0.20 | 0.30 | 0.30 |
| Hole (mm) | 0.05 | 0.05 | 0.10 | 0.10 |

Since only one trial item, was deburred at each combination of feeding speed/revs per min., the results cannot be handled statistically. However, the following tendencies were shown:

with increasing revolutions per minute, the removal of material is increased and herewith the chamfering of the edge, with increasing feeding speed, the removal of material is reduced and herewith the chamfering of the edge.

Deburring Dependent on Diameter of the Hole

Deburring was carried out on an item in which holes of different diameters had been drilled.

The results for the radii of the edges with a roller speed of 1360 rpm and a feeding speed of 1 m/min. were as follows:

| Hole diameter (mm) | 2.4 | 4.0 | 32.0 | outer edge |
|---|---|---|---|---|
| Edge radius (mm) | 0.15 | 0.2 | 0.3 | 0.2 |

From this it will be seen that the larger the diameter of the hole, the larger the chamfering of the edge, but even with very small holes (diameter=2.4 mm) the deburring was satisfactory.

Deburring with Simultaneous Processing of Items with Different Plate Thicknesses With a roller speed of 1360 rpm and a feeding speed of 1 m/min., the following results were obtained for an item which at the edge had a first projection which was 1.4 mm high, thereafter a recess with a length of 30 mm followed by a second projection which was 5.5 mm high, thereafter another recess with a length of 46 mm, and then yet a third and final projection with a height of 1.4 mm:

At the transition from the first projection to the followimg recess, the measurement of the radius at the edge of the projection was 0.3 mm. At the transition from the recess to the second projection, the measurement of the radius at the edge of the projection was 0.8 mm, and at the transition from the second recess to the third and final projection, the measurement of the radius at the edge of the projection was 0.3 mm.

Consequently, it is possible to deburr plate items of different thicknesses. Although the chamfer on the edge of the thicker parts is larger, it is however permissible.

Deburring Dependent on the Distance Between Plate Items Arranged at the Side of One Another.

With a roller speed of 1360 rpm and a feeding speed of 1 m/min., and plate items all having a thickness of 1.2 mm, the following results were obtained:

| Distance to next plate item (mm) | 10 | 13 | 20 |
|---|---|---|---|
| Edge radius (mm) | 0.2 | 0.3 | 0.2 |

Even with a distance of only 10 mm to the side of the next plate item, the chamfering of the edge was very good.

Deburring when Processing Both Sides

With a roller speed of 1360 rpm and a feeding speed of 1 m/min., and plate items which had a thickness of 1.6 mm and a hole of 2.4 mm in diameter, the following results were obtained:

On the first side to be processed, the measurement of the chamfer at the edge of the hole was 0.05 mm, and at the outer edge 0.4 mm. The plate item was, then turned over and exposed to deburing on the other side, where the measurement of the chamfer at the edge of the hole was 0.1 mm, and at the outer edge the edge chamfer was 0.4 mm. The deburring of opposite sides thus has no influence on each other.

Surface Structure

Using analysis equipment from Fa. Rodenstock, there followed an evaluation of the surface structure of the plate items which had been deburred. The evaluation was carried out opto-electrically with the equipment. The plate item proved to have minute indentations which were approx. 0.5 mm in length and up to 0.6 $\mu$m in depth. The characteristic aspect of these indentations was that on both sides of this "valley" there were peaks or raised portions. Since these indentations even in the maximum case only to a minimum degree damage the plate layer (6 $\mu$m as compared with 80 $\mu$m plate layer thickness), and as the indentations or irregularities are reduced by a subsequent galvanic treatment, the indentations can not be considered as being critical.

Reduction of Plate Thickness

In order to evaluate the reduction in plate thickness resulting from deburring according to the invention, three trial items were examined:

| | Plate layer thickness | |
|---|---|---|
| | processed side | unprocessed side |
| Wear with maximum effect | | |
| edge chamfer 0.4 mm, rpm = 1500/min, | 80 $\mu$m | 80 $\mu$m |

-continued

| | Plate layer thickness | |
|---|---|---|
| | processed side | unprocessed side |
| feeding speed 1 m/min, thickness 1.6 mm Wear with normal effect, | | |
| edge chamfer 0.2 mm, rpm = 1240/min, feeding speed 1.5 m/min, thickness 1.6 min Wear with thinner plate items, | 80 μm | 80 μm |
| edge chamfer 0.3 mm rpm = 1360/min, feeding speed 1 m/min, thickness 1.2 mm | 65 μm | 65 μm |

Even at maximum effect (longest period of influence at maximum rpm and maximum feeding speed), no wear of any significance can be observed on the surfaces.

Conclusion and Evaluation

Using the method according to the invention for deburring by means of rotating deburring rollers, three points were investigated:

edge chamfering, wear on the plate items, and surface structure.

Very good edge chamfering was achieved. Upon investigation of the influence of the rpm and feeding speed, the following tendencies were observed:

when the rpm is increased, the edge chamfering also increases, when the feeding speed is increased, the edge chamfering is reduced.

Holes were also deburred, and here it was found that the larger the hole, the larger the edge chamfer. Even with holes of small diameter, in the above-mentioned case a diameter of 2.4 mm, the deburring was adequate.

Items with different thicknesses could be processed simultaneously.

Even with a distance of 10 mm to the side of an adjacent plate item, the deburring was very good.

The deburring of an opposite second side of a plate item does not have any influence on the deburring of the first side.

All burrs present were effectively removed.

No folding-back of burrs has been observed.

No real wear could be observed on the surfaces of the plate parts. The surface structure of the plate parts, however, changes in relation to the initial structure. There have proved to be scattered indentations which, however, as a consequence of their size (6 μm as compared with 80 μm plate layer thickness), must be considered to be without significance, in that irregularities are subsequently reduced by a galvanic treatment.

The investigation thus established that the method according to the invention can with advantage be used for the deburring of items such as ribs for aircraft wings or similar objects.

I claim:

1. A method for deburring metal items which have sharp edges or burrs comprising:

providing a deburring tool having a number of deburring rollers composed of a plurality of deburring disks, each deburring disk consisting of a circularly-cut piece of abrasive material provided with radial slits to form a large number of deburring fingers, said deburring disks being secured on a plurality of spindle axles which extend radially outwards to form a drive, said deburring rollers being rotated around the spindle axles, said spindle axles being turned around a turning axle which extends at a right-angle to the spindle axles; and feeding the items under the deburring tool which sweeps the surface of the items and moving the drive with the spindle axles in a reciprocating manner in a direction transverse to the feeding direction of the items.

2. The method according to claim 1 further comprising securing the items by vacuum while feeding the items under the deburring tool.

3. The method according to claim 1, wherein the items are ribs for aircraft wings.

4. The method according to claim 1, further comprising applying a surface treatment to the items after the items have been deburred.

5. The method of claim 1, further comprising rotating the spindle axles and deburring rollers in opposite directions relative to each other such that the deburring fingers on a first spindle axle rotate in a first direction and the deburring fingers on a second spindle axle rotate in a second direction opposite to the first direction.

* * * * *